United States Patent [19]

Wendel et al.

[11] Patent Number: 4,939,325

[45] Date of Patent: Jul. 3, 1990

[54] PUSH-BUTTON MULTI-POSITION SWITCH

[75] Inventors: Peter Wendel, Würenlos; Heinz Waser, Schlieren, both of Switzerland

[73] Assignee: Contraves AG, Zürich, Switzerland

[21] Appl. No.: 345,448

[22] Filed: May 1, 1989

[30] Foreign Application Priority Data

May 6, 1988 [CH] Switzerland ..... 01720/88

[51] Int. Cl.[5] ..... H01H 13/00; H01H 13/14

[52] U.S. Cl. ..... 200/552; 200/11 TW; 74/128

[58] Field of Search ..... 200/552, 5 E, 5 EA, 200/11 TW; 74/128, 129

[56] References Cited

U.S. PATENT DOCUMENTS

| | | | |
|---|---|---|---|
| 3,435,167 | 3/1969 | Pfleger | 200/552 |
| 3,626,452 | 12/1971 | Winter et al. | 200/552 |
| 3,748,915 | 7/1973 | Winter et al. | 74/128 |
| 4,112,278 | 9/1978 | Greiner et al. | 200/552 |
| 4,383,453 | 5/1983 | Lehmann et al. | 74/128 |
| 4,503,303 | 3/1985 | Fourcaulx | 200/552 |
| 4,647,732 | 3/1987 | Yamanaka et al. | 200/552 |
| 4,780,584 | 10/1988 | Sakakino et al. | 200/11 TW |

FOREIGN PATENT DOCUMENTS

| | | | |
|---|---|---|---|
| 0006967 | 1/1980 | European Pat. Off. . | |
| 2545719 | 4/1977 | Fed. Rep. of Germany . | |
| 2835731 | 2/1980 | Fed. Rep. of Germany . | |
| 3429443 | 2/1986 | Fed. Rep. of Germany | 200/552 |
| 7139879 | 6/1973 | France . | |
| 1520451 | 8/1978 | United Kingdom . | |

*Primary Examiner*—Henry J. Recla
*Assistant Examiner*—Glenn T. Barrett
*Attorney, Agent, or Firm*—Werner W. Kleeman

[57] ABSTRACT

In the stepping or indexing drive of a character drum having secured thereat a pinion, wherein there is provided an actuation plunger for rotary motion of the pinion in the one direction and another actuation plunger for rotary motion of the pinion in the other direction, there must be prevented that the character drum while rotating from one index position to the next can be stopped and remain in an intermediate position between two index positions. For this purpose, there is provided a movable locking or detent element which coacts with both actuation plungers and with inclined surfaces formed at the switch housing. This locking or detent element is brought by each individual actuation plunger, at the start of its actuating path, into a locking position for the other actuation plunger and retained in this locking position to positively prevent simultaneous actuation of both actuation plungers.

6 Claims, 3 Drawing Sheets

PUSH-BUTTON MULTI-POSITION SWITCH

BACKGROUND OF THE INVENTION

The present invention broadly relates to indexible stepping mechanisms for switches and, more specifically pertains to a new and improved construction of a push-button multi-position switch.

Generally speaking, the push-button multi-position switch of the present invention comprises a symbol or numeric drum or wheel, broadly simply referred to as a character drum or wheel, which is rotatably mounted in a switch housing and provided with contact elements and a drive pinion, and two individual actuation plungers arranged at both sides of the axle of the character drum or wheel and which are displaceable in the switch housing along an actuation path and against the force of a restoring spring. The two individual actuation plungers each comprise a switching or indexing arm and a latching or locking arm for the stepping or step-by-step drive of the character drum or wheel in both possible directions of rotation thereof, each such switching or indexing arm and each such latching or locking arm being provided to engage with their free ends at teeth of the drive pinion. The push-button multi-position switch further includes a locking or detent element which is displaceably guided at the switch housing in a direction substantially transverse to the predetermined direction of actuation of the two individual actuation plungers. This locking or detent element is movable by each individual actuation plunger into a locking position for the other individual actuation plunger.

In a multi-position switch known to the art as disclosed, for example, in German Published Patent Application No. 2,545,719, published April 14, 1977, each actuation plunger comprises a restoring spring which is a tension spring braced between the respective actuation plunger and the switch housing. The locking or detent element is guided as a movable separate part in a recess of the housing wall, which recess is located between the actuation plungers and extends substantially perpendicular to the direction of the working movement or stroke of the actuation plungers. This movable separate part coacts with a slanting or inclined surface provided at each actuation plunger. When both actuation plungers are non-operative, the locking or detent element must necessarily possess a certain clearance of motion such that the locking or detent element, upon actuating one actuation plunger, can lock the other inoperative actuation plunger only when the operative actuation plunger has been totally actuated, i.e. only after accomplishing the linear working movement or stroke and thus a complete switching or indexing step. Since it is therefore possible to simultaneously move both actuation plungers each by about one-half the actuation path or stroke, the possibility cannot be totally excluded that the character drum or wheel is thereby brought into and retained at an intermediate position, be this unintentional or not. However, this shortcoming or disadvantage is not acceptable in most applications of such multi-position switches. A further considerable disadvantage of this known multi-position switch is seen in the fact that the manufacture and, in particular, the assembly of the separate restoring springs and of the additional separate locking or detent element is labor-intense and time-consuming such that series or mass production of this known multi-position switch is complicated and this again increases its manufacturing costs.

SUMMARY OF THE INVENTION

Therefore, with the foregoing in mind it is a primary object of the present invention to provide a new and improved construction of a push-button multi-position switch which is not afflicted with the aforementioned drawbacks and shortcomings of the prior art constructions.

Another important object of the present invention aims at the provision of a new and improved construction of a push-button multi-position switch by means of which, on the one hand, only complete definite switching or indexing steps of the character drum or wheel are possible and, on the other hand, the assembly and thus the series or mass production are substantially simplified and facilitated.

Yet a further significant object of the present invention aims at providing a new and improved push-button multi-position switch which is relatively simple in construction and design, is composed of less individual elements than prior art constructions, can be economically feasibly manufactured in accordance with conventional techniques, is highly reliable in operation and not readily subject to malfunction or breakdown.

Now in order to implement these and still further objects of the present invention which will become more readily apparent as the description proceeds, the push-button multi-position switch of the present invention is manifested, among other things, by the features that the locking or detent element is structured as a substantially rod-shaped end region of the restoring or return spring formed as a undulatory spring and common to both individual actuation plungers, such substantially rod-shaped end region of the restoring or return spring bearing upon the two individual actuation plungers. Furthermore, this substantially rod-shaped end region of the restoring or return spring is slidably guided with its ends at two guide surfaces of the switch housing, such guide surfaces each inclinedly extending with respect to the predetermined direction of actuation of the two individual actuation plungers.

In this manner, there is achieved the beneficial result that upon actuating one actuation plunger the other inoperative actuation plunger is locked or latched right at the beginning or start of the actuation path or stroke of the actuated actuation plunger. It is thus impossible to bring the character drum or wheel by some or any manipulations into an intermediate position and leave it there. Furthermore, since only one single undulatory spring serves to restore both individual actuation plungers or, in other words, to return each actuated individual actuation plunger into its rest or neutral position upon completion of the switching or indexing stop, and since at the same time the only one single undulatory spring also forms the locking or detent element, the manufacture and particularly the assembly of the push-button multi-position switch are essentially facilitated.

The substantially rod-shaped end region of the restoring spring advantageously forms the one end of a wave-like structured restoring or return spring substantially in the form of an ammunition-clip spring.

The two guide surfaces of the switch housing for slidably guiding the substantially rod-shaped end region of the restoring or return spring advantageously also serve to form respective end or limit stops for limiting the predetermined actuation path or stroke of the two individual actuation plungers.

Each switching or indexing arm preferably comprises a guide surface which is remote from the related actuation plunger, such guide surface serving to coact with guide buffer means provided at the switch housing as well as with a pinion tooth following a previously actuated pinion tooth.

The switching or indexing arm and the latching or locking arm of each of the two individual actuation plungers are preferably deflectable independently of each other.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analagous components and wherein.

DETAILED DESCRIPTION OF THE PREFERRED EMBODIMENTS

Figure 1:
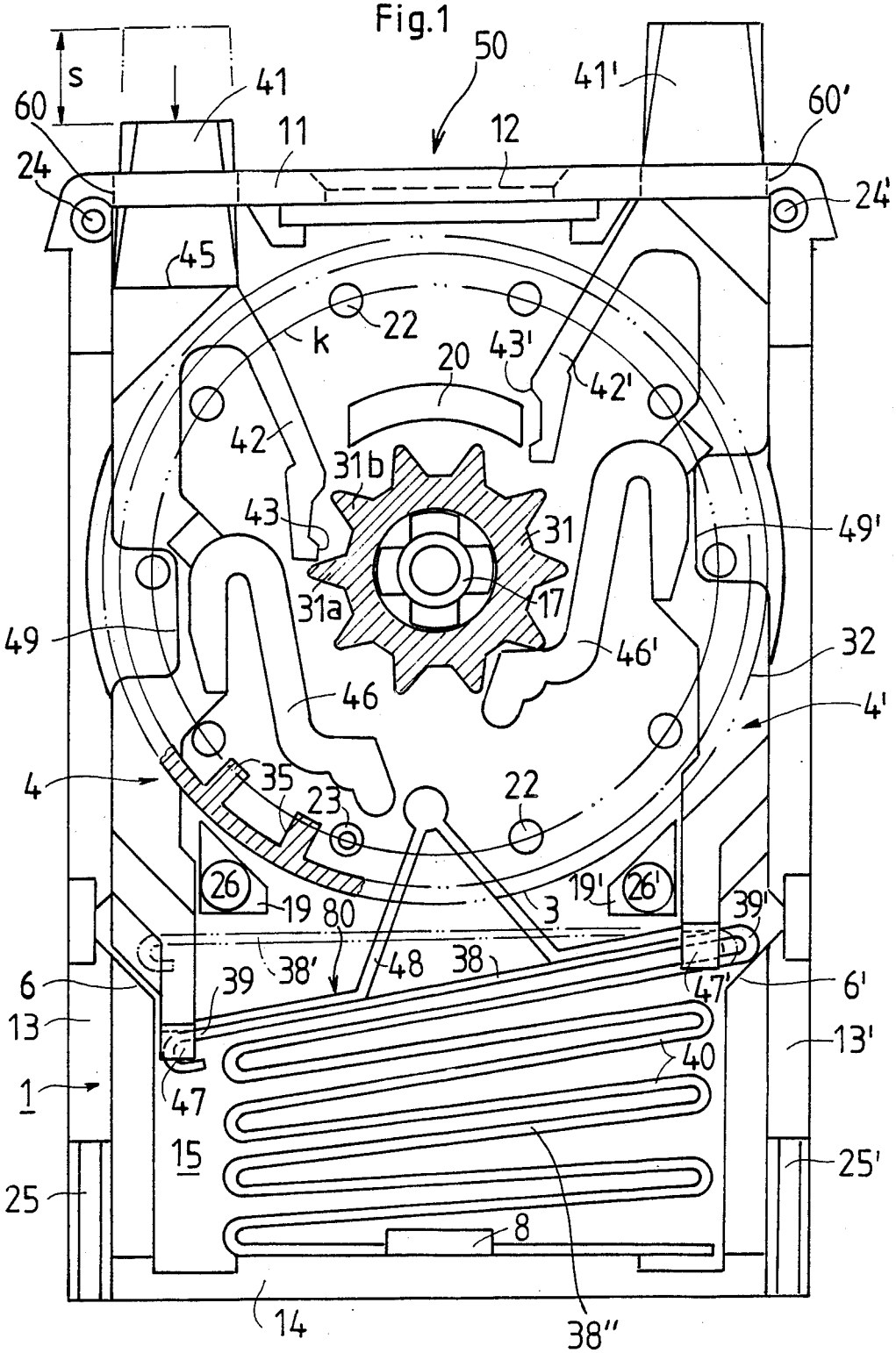
FIG. 1 illustrates in a side view a push-button multi-position switch seen in the direction of the axle of a character drum or wheel and constructed according to the invention, whereby a printed circuit board closing the switch housing is omitted and only a drive pinion as well as a circumferential or peripheral portion of the character drum or wheel are shown in section.

Describing now the drawings, it is to be understood that to simplify the showing thereof, only enough of the structure of the exemplary embodiment of the push-button multi-position switch has been shown therein as is needed to enable one skilled in the art to readily understand the underlying principles and concepts of the present invention. Turning attention now specifically to FIG. 1 of the drawings, the push-button multi-position switch 50 illustrated therein by way of example and not limitation, will be seen to refer to, for example, a decade or ten-position or ten-point pre-selecting or encoding switch, the positions of which are numerically indicated by the numbers 0 through 9 in known manner by means of a symbol an a numeric drum or wheel 3, as previously mentioned and generally referred to herein as a character drum or wheel 3. It stands to reason that this push-button multi-position switch 50 can be also constructed with more or less than ten positions or points.

In the side and partially sectional view of the push-button multi-position switch 50 there will be recognized an essentially prismatic or prism-shaped switch housing 1 which comprises a housing base or bottom 15 having a front wall 11, lateral or side walls 13 and 13', and a rear wall 14 formed thereat. A printed circuit board 16 (FIG. 2) arranged in substantially parallel relationship to the housing base or bottom 15 and connected with the latter by means of supporting or carrying pins 26, 26' and 17' serves as a cover or cap of the switch housing 1.

In the front wall 11 of the switch housing 1 there is located a window 12 through which one of the numbers arranged at the circumference or periphery 32 of the character drum or wheel 3 is visible, such one number or reading corresponding with the actual switching or indexing position. The character drum or wheel 3 is rotatably mounted at an axle journal or axle neck 17 which is formed at the housing base or bottom 15 and, in accordance with conventional injection molding techniques, preferably possesses a cross-shaped section or profile. At the one end face or side 3' of the character drum or wheel 3 depicted FIG. 2 there are secured contact elements like, for example contact arms or wipers 34 which coact with not particularly illustrated conductor tracks provided at the printed circuit board 16. The hub or driving collar of the character drum or wheel 3 is structured as a drive pinion 31 which possesses teeth **31*a*, 31*b* and so forth in the predetermined number of switching or indexing positions of the character drum or wheel 3**.

At a graduated circle k which, as outlined or indicated in FIG. 1, is concentric to the character drum or wheel 3, there are provided in the housing base or bottom 15 through-bores or through-holes 22 in the predetermined number of switching or indexing positions of the character drum or wheel 3. Stop pins can be inserted from the exterior into such through-bores or through-holes 22, one such stop pin being depicted in FIGS. 1 and 2 and conveniently designated by reference character 23. Such stop pin 23 engages with stops or detents 35 which are provided at the circumference or periphery 32 of the character drum or wheel 3 and which inwardly project into the region or zone of the graduated circle k. In this manner, the angle of rotation of the character drum or wheel 3 can be accordingly limited such that the indexing of certain switching positions of the push-button multi-switch 50 can be precluded in accordance with operational requirements.

For the indexing or stepping rotational drive of the character drum or wheel 3 there are located in the switch housing 1 two individual, functionally independent actuation plungers 4 and 4' in substantially mirror-symmetrical manner with respect to the axle journal or axle neck 17 of the character drum or wheel 3. One of these two individual actuation plungers 4 and 4' is responsible for the movement of the character drum or wheel 3 in the one direction of rotation thereof, while the other actuation plunger governs the return movement of such character drum or wheel 3 in the other direction of rotation thereof. At one end of each of the two individual actuation plungers 4 and 4' there are formed thereat push-buttons 41 and 41' or equivalent structure, respectively. The other end of each of the two individual actuation plungers 4 and 4' coacts, as described hereinafter in greater detail, with a wave-like or undulatory formed restoring or return spring 40 which preferably possesses the shape of a so-called ammunition-clip spring. The push-buttons 41 and 41' each protrude or project through corresponding or respective openings 60 and 60' at the front wall 11, and the restoring or return spring 40 is conveniently supported at the opposite rear wall 14 of the switch housing 1.

Both individual actuation plungers 4 and 4' are joined together at their spring-sided ends preferably by means of a flexible and expandable traverse 48. The individual actuation plungers 4 and 4' together with the traverse 48 can be economically feasibly fabricated from plastic material as a one-piece injection molded part. The two actuation plungers 4 and 4' each can be displaced against the action of the restoring or return spring 40 out of a rest or neutral position, as shown at the right in FIG. 1 for the actuation plunger 4', and in longitudinal direction along the lateral or side walls 13 and 13', respectively. The actuation path or working stroke of the individual actuation plungers 4 and 4', respectively, is designated by reference character S as shown in FIG. 1 for the herein depicted actuated actuation plunger 4. A positive or form-closed guidance and a linear working movement are thus provided and ensured, on the one hand, by means of the lateral or side walls 13 and 13' of the switch housing 1 and, on the other hand, by means of respective guide blocks or cheeks 19 and 19' as well as by means of the openings 60 and 60' for the insertion and guiding of the corresponding push-buttons 41 and 41' or equivalent structures. At the individual actuation plungers 4 and 4' there are provided respective recesses 49 and 49' in order not to obstruct the working movement or stroke of the respective actuation plunger 4 or 4', in the event that a stop pin 23 should be inserted into one of the through-bores or through-holes 22 located in the region of such working movement or stroke.

Figure 2:
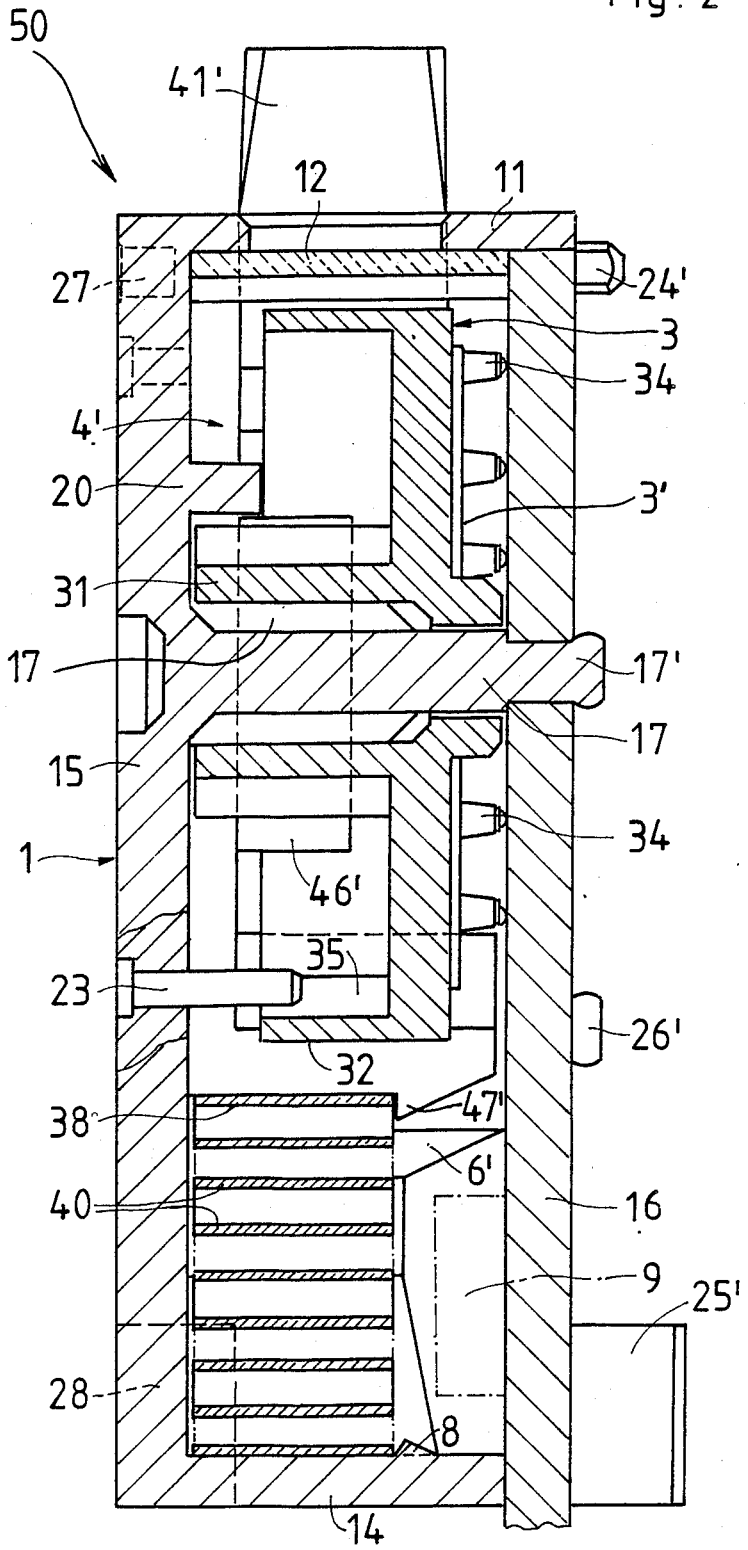
FIG. 2 is a longitudinal sectional view of the push-button multi-position switch illustrated in FIG. 1, taken substantially through the axle of the character drum or wheel.

As seen by referring to FIG. 2, the width of the strip or band forming the restoring or return spring 40 is substantially smaller than the depth of the switch housing 1. There is thus provided within the switch housing 1 a free space between the restoring or return spring 40 and the schematically protrayed printed circuit board 16. Such a free space can be conveniently used for accomodating switching components, for instance diodes 9, to be arranged or mounted at the printed circuit board 16. The restoring or return spring 40 is retained or held in the housing base or bottom 15 of the switch housing 1 by a cam or stop 8 located at the rear wall 14, as well as by cams or stops 47 and 47' located at associated spring-sided ends of the two individual actuation plungers 4 and 4', respectively.

At each of the actuation plungers 4 and 4' there are independently formed switching or indexing arms 42 and 42', respectively, and latching or locking arms 46 and 46', respectively, such that they essentially protrude away from the actuation plungers 4 and 4' and essentially extend toward the drive pinion 31. The free ends of the two switching or indexing arms 42 and 42' and the free ends of the two latching or locking arms 46 and 46' serve to engage the pinion teeth 31*a*, 31*b* and so forth as will be described in greater detail hereinafter.

Since, as mentioned, the two individual actuation plungers 4 and 4' are essentially of the same construction, being structured in substantially mirror-image relationship, the following disclosure of details of the actuation plunger 4 should suffice for the understanding of the construction of the actuation plunger 4'.

The switching or indexing arm 42 and the latching or locking arm 46 are formed at the actuation plunger 4 to be elastically displaceable or deflectable independently of one another. The switching or indexing arm 42 is laterally displaceable or deflectable by means of a relatively small specific force. However, this switching or indexing arm 42 can transfer, analogous or similar to a pawl or catch, the longitudinal movements of the actuation plunger 4 to the pinion teeth 31*a*, 31*b* and so forth. In comparison with the switching or indexing arm 42, the latching or locking arm 46 represents a relatively hard bending or spiral spring in that the latching or locking arm 46 is substantially wider than the switching or indexing arm 42, as best seen by referring to the illustration of the latching or locking arm 46' in FIG. 2. Nevertheless, the latching or locking arm 46 can be independently and laterally deflected, i.e. without influencing or affecting the position of the entire actuation plunger 4 or of the switching or indexing arm 42. Likewise in comparison with the restoring or return spring 40 the latching or locking arm 46 represents a "hard" spring.

The switching or indexing arms 42 and 42' each comprise, at the side thereof which is remote from the associated actuation plungers 4 and 4', respective flat or planar guide surfaces 43 and 43' which during the actuation of the respective one of the two actuation plungers 4 and 4' coact, on the one hand, with a guide block or buffer 20 formed at the housing base or bottom 15 and, on the other hand, with the pinion tooth which follows the immediately previously actuated pinion tooth as viewed in the related direction of rotation. The end or final position of each actuation plunger 4 or 4' upon actuation thereof is determined by respective inclined or sloping surfaces 6 and 6', which are provided at the inner side or inside of the respective lateral or side walls 13 and 13', so that the restoring or return spring 40 cannot be overloaded. The end or neutral position of the resting or inoperative actuation plunger, for instance the actuation plunger 41' in FIG. 1, is defined by a stop face or surface 45 which comes to bear at the inner side or inside of the front wall 11.

A last or final layer 38 of the undulatory restoring or return spring 40, such last or final layer 38 facing or confronting the actuation plungers 4 and 4', is longer at both ends than the other layers or turns 38" of the restoring or return spring 40. As seen by referring to FIG. 1, the position of the last or final layer 38, when both actuation plungers 4 and 4' are inoperative, is shown in dash-dotted lines and conveniently designated by reference character 38'. In this manner, there is formed a more or less rigid, rod-shaped and movable locking or detent element 80 which coacts with each of the two individual actuation plungers 4 and 4' and, by means of end portions 39 and 39' of the rod-shaped locking or detent element 80, with each one of the inclined or sloping guide surfaces 6 and 6' located at the switch housing 1, such guide surfaces 6 and 6' inclinedly extending with respect to the longitudinal direction of the actuation plungers 4 and 4'. The mode of operation of this rod-shaped locking or detent element 80 will be hereinafter described.

Having now had the benefit of the detailed description of the construction of the push-button multi-position switch 50 constructed according to the invention, the mode of operation of the stepping or indexing drive of the character drum or wheel 3 by means of the two individual actuation plungers 4 and 4' will now be considered in conjunction with the FIGS. 1 and 3 and is as follows:

FIG. 1 shows the situation at the end of a completed indexing or switching step accomplished in counterclockwise direction by the actuated actuation plunger 41. FIG. 3 shows the push-button multi-position switch 50 in an intermediate phase during an indexing or switching step. In other words, the character drum or wheel 3 and the drive pinion 31 secured thereat are in a snap condition or dead-center position.

Figure 3:
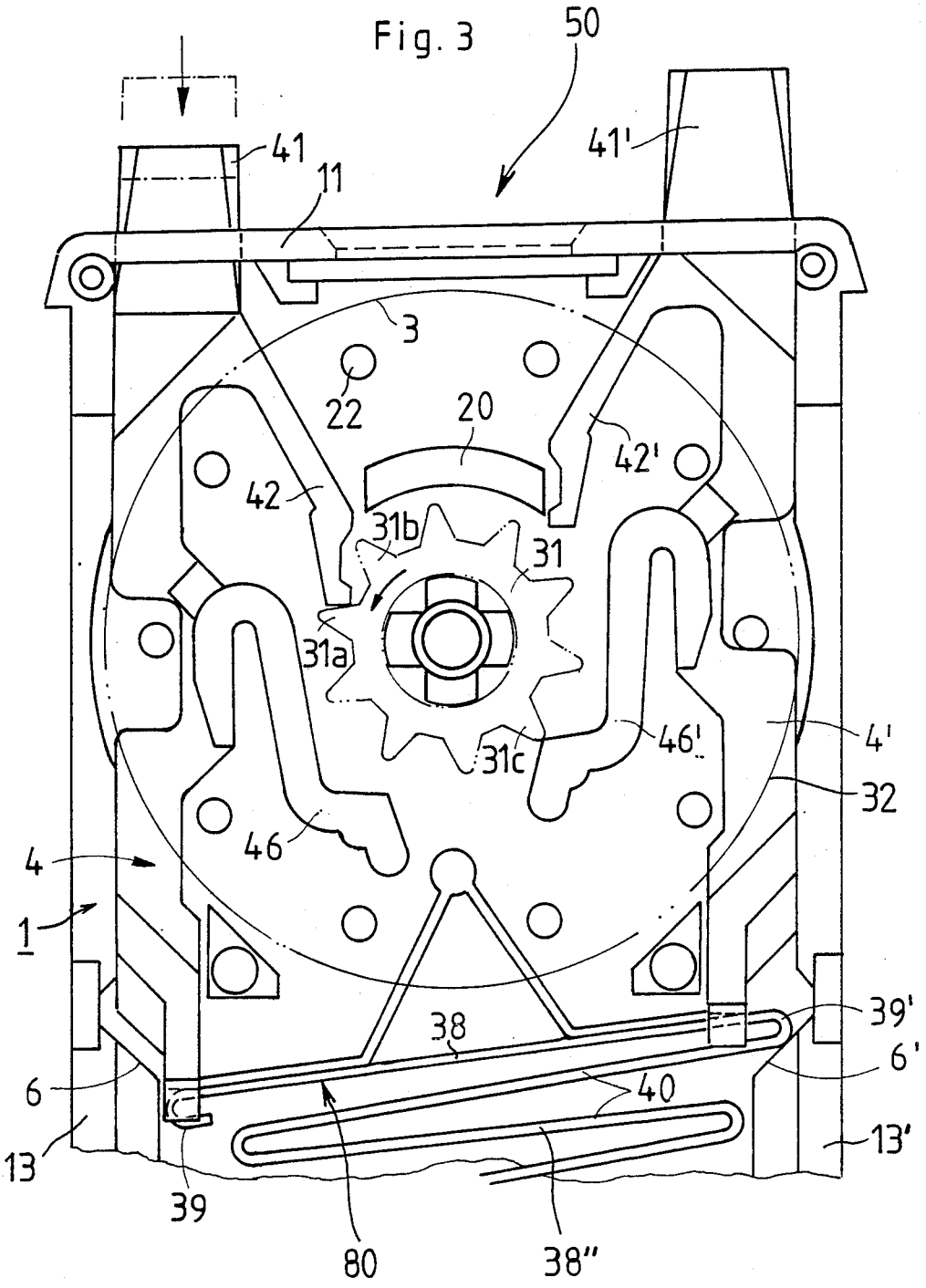
FIG. 3 is a fragmentary side view of the push-button multi-position switch illustrated in FIG. 1 and showing the same in its snap condition or dead-center position.

In a non-operated push-button multi-position switch 50 both individual actuation plungers 4 and 4' assume the rest or neutral position which is best seen by referring to the actuation plunger 4' depicted in FIGS. 1 and 3. This rest or neutral position is retained or held by the restoring or return spring 40 with a relatively low bias. The latching or locking arms 46 and 46' each engage a related tooth space at the drive pinion 31 in order to lock the character drum or wheel 3. Upon actuating the actuation plunger 4, the same is linearly displaced and during such linear displacement the position of the switching or indexing arm 42 and the position of the latching or locking arm 46 with respect to the actuation plunger 4 initially are not changed or altered and also the character drum or wheel 3 initially is not counterclockwisely rotated because the switching arm 42 of the actuation plunger 4 stays out of contact with the teeth of the drive pinion 31 during the initial phase of the actuation plunger displacement. However, right at the beginning or start of the actuation path S of the actuation plunger 4, the end portion 39 of the rod-shaped locking or detent element 80 defined by the last or final layer 38 of the restoring or return spring 40 slides across the inclined or sloping guide surface 6 and the rod-shaped locking or detent element 80 is moved to the right, as seen in FIG. 1, into a locking position for the other actuation plunger 4', in which locking position the actuation of this other actuation plunger 4' is rendered impossible.

As soon as the free end of the switching or indexing arm 42 bears upon the pinion tooth 31*a*, the character drum or wheel 3 starts to rotate and the end cam of the latching or locking arm 46' at the non-operative actuation plunger 4' is lifted out of the respective tooth space upon lateral deflection of the latching or locking arm 46'. This operation requires a considerably greater force exertion at the actuation plunger 4 than the force to overcome the restoring or return spring 40. This force input prevails until the upper edge of the pinion tooth 31*c* slides past the latching edge of the latching or locking arm 46' such that all at once the biased and maximum deflected latching or locking arm 46' further rotates the drive pinion 31 at the pinion tooth 31*c*. In this manner, the switching or indexing arm 42 and thus the actuation plunger 4 are substantially relieved of the greater force or load. The character drum or wheel 3 is then totally rotated into the next latching position which is defined by the engagement of the latching or locking arm 46' in the next following pinion tooth space or gap. Because of the previous loading of the actuation plunger 4 with a high actuation force, its switching or indexing arm 42 directly follows the pinion tooth 31*a* until the actuation plunger 4 reaches the end or final position of the inclined or sloping guide surface 6. During this final drop movement or motion of the actuation plunger 4 the next following pinion tooth 31*b* presses against the guide surface 43 of the switching or indexing arm 42, thus deflecting the latter towards the actuation plunger 4. The end or final position and the form of the actuated actuation plunger 4 is apparent from the left half of the illustration in FIG. 1.

By virtue of the soft spring characteristic of the switching or indexing arm 42, the rotational movement of the character drum or wheel 3 is not considerably braked upon deflection of the switching or indexing arm 42 and the friction of the actuation plunger 4 is not increased. In the aforesaid end or final position of the actuation plunger 4 only the restoring or return force of the compressed restoring or return spring 40 is perceived at the push-button 41, such restoring or return force being minor if compared with the previously overcome latching force of the latching or locking arm 46'. It is apparent that the inoperative actuation plunger 4' is locked right from the moment of actuation of the actuation plunger 4 because of the lateral movement of the bar or rod-shaped locking or detent element 80 which is defined by the last or final spring layer or coil 38 and transversely arranged with respect to the longitudinal direction of the actuation plunger 4. In this manner, an intentional or accidental simultaneous actuation of both individual actuation plungers 4 and 4' is not possible.

Upon release of the push-button 41, the restoring or return spring 40 guides the actuation plunger 4 back into the rest or neutral position. The guide surface 43 of the switching or indexing arm 42 thereby slides across the pinion tooth 31*b*. However, the rotational position of the character drum or wheel 3 remains unchanged by virtue of the substantial latching action provided by the latching or locking arm 46'.

Upon actuating the push-button 41' instead of the push-button 41, the stepping or indexing drive of the character drum or wheel 3 is carried out precisely in analogous manner, but in the opposite or clockwise direction of rotation, so that the rod-shaped locking or detent element 80 defined by the last or final layer 38 of the restoring or return spring 40 is moved to the left into a locking position for the actuation plunger 4.

As can be derived from the above description of the mode of operation of the push-button multi-position switch 50, the rotation of the character drum or wheel 3 is effected in the course of the linear movement or stroke of the operated or actuated actuation plunger 4 or 4' by a jolt-like complete indexing or switching step and thus without uncontrolled partial forward movements or return movements of the character drum or wheel 3. A particular advantage of the push-button multi-position switch 50 as described hereinbefore is seen in the definite pressure point or center and the snap action at the two actuation plungers 4 and 4'.

It is evidently possible, as shown in FIG. 3, to actuate the one actuation plunger 4 only until the snap position is reached and then release the actuation plunger 4. However, due to the then missing latching action of the latching or locking arm 46' at the upper edge of the pinion tooth 31*c*, the character drum or wheel 3 will spring back into the rest or neutral position as soon as the already deflected switching or indexing arm 42 slides back across the pinion tooth 31*b*.

In conjunction with FIGS. 1 and 2 there are still constructional elements to describe which render possible the alignment and centering of an assembly of several identical push-button multi-position switches 50. For this purpose, switch housing 1 comprises at the side closed by the printed circuit board 16 two protruding center pins 24 and 24' and two lateral guide flaps 25 and 25'. At the housing base or bottom 15 there are located two oppositely arranged recesses 27 and 28. The lateral arrangement of the flaps 25 and 25' outside the lateral or side walls 13 and 13' has the advantage that additional space can be saved on the printed circuit board 16 for conductor tracks to be led out via the rear wall 14 of the switch housing 1.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A push-button multi-position switch, comprising:

a switch housing;

a character drum rotatably mounted in said switch housing for stepwise rotation in two possible directions of rotation;

said character drum being provided with contact elements;

said character drum being further provided with a drive pinion;

said drive pinion having a predetermined number of teeth and defining two sides;

two individual actuation plungers each of which is arranged at one of said two sides of said drive pinion;

said two individual actuation plungers each defining a predetermined actuation path which extends in a predetermined direction of actuation;

restoring spring means provided in said switch housing and having a predetermined spring force;

said two individual actuation plungers being displaceable along said predetermined actuation path and against said predetermined spring force of said restoring spring means;

said two individual actuation plungers each comprising a switching arm and a latching arm for stepwise rotation of said character drum in said two possible directions of rotation;

said switching arms and said latching arms each having a free end for operative engagement with said predetermined number of teeth of said drive pinion;

detent means displaceably guided at said switch housing in a direction substantially transverse to said predetermined direction of actuation of said two individual actuation plungers;

said detent means being displaceable by each of said two individual actuation plungers into a locking position for the other actuation plunger;

said restoring spring means being structured as an undulatory spring;

said detent means being structured as a substantially rod-shaped end region of said undulatory spring;

said substantially rod-shaped end region of said undulatory spring bearing upon both said individual actuation plungers and having two end portions;

said switch housing having two guide surfaces each inclinedly extending relative to said predetermined direction of actuation; and said two end portions of said substantially rod-shaped end region of said undulatory spring being slidably guided at respective ones of said two guide surfaces.

2. The push-button multi-position switch as defined in claim 1, wherein:

said undulatory spring is substantially in the form of an ammunition-clip spring.

3. The push-button multi-position switch as defined in claim 1, wherein:

said two guide surfaces also define end stops for limiting said predetermined actuation path of said two individual actuation plungers.

4. The push-button multi-position switch as defined in claim 1, further including:

a guide block provided at said switch housing between said two individual actuation plungers;

said switching arms each comprise a guide surface which is remote from the related actuation plunger;

said guide surface at each one of said switching arms serving to coact with said guide block and with a related tooth of said predetermined number of teeth of said drive pinion; and said related tooth directly following a previously actuated tooth of said predetermined number of teeth of said drive pinion.

5. The push-button multi-position switch as defined in claim 4, wherein:

said switch housing comprises boreholes arranged along a graduated circle which is substantially concentric to said character drum;

said boreholes serving to accommodate stop pins which can be inserted from externally of the switch housing;

said character drum possessing a circumference;

said character drum containing a plurality of stop elements located at the circumference thereof; and said insertable stop pins serving in conjunction with said plurality of stop elements to limit the angle of rotation of said character drum.

6. The push-button multi-position switch as defined in claim 1, wherein:

said switching arm and said latching arm of each of said two individual actuation plungers are deflectable independently of each other.

* * * * *